166-273 SR
8/19/80 XR 4,217,956

United States Patent [19] [11] 4,217,956
Goss et al. [45] Aug. 19, 1980

[54] METHOD OF IN-SITU RECOVERY OF VISCOUS OILS OR BITUMEN UTILIZING A THERMAL RECOVERY FLUID AND CARBON DIOXIDE

[75] Inventors: Michael J. Goss; Douglas I. Exall, both of Sherwood Park, Canada

[73] Assignee: Texaco Canada Inc., Calgary, Canada

[21] Appl. No.: 942,244

[22] Filed: Sep. 14, 1978

[51] Int. Cl.[2] ..... E21B 43/24
[52] U.S. Cl. ..... 166/272; 166/273; 166/303
[58] Field of Search ..... 166/272, 273, 303

[56] References Cited

U.S. PATENT DOCUMENTS

| | | | |
|---|---|---|---|
| 3,358,762 | 12/1967 | Closmann | 166/303 |
| 3,455,392 | 7/1969 | Prats | 166/303 |
| 3,739,852 | 6/1973 | Woods et al. | 166/303 |
| 3,782,470 | 1/1974 | West et al. | 166/303 |
| 3,976,137 | 8/1976 | Bousaid | 166/272 |
| 4,006,778 | 2/1977 | Redford et al. | 166/303 X |
| 4,026,358 | 5/1977 | Allen | 166/272 X |
| 4,099,568 | 7/1978 | Allen | 166/272 X |
| 4,121,661 | 10/1978 | Redford | 166/272 X |
| 4,127,172 | 11/1978 | Redford et al. | 166/272 X |
| 4,133,382 | 1/1979 | Cram et al. | 166/272 X |

FOREIGN PATENT DOCUMENTS

| | | | |
|---|---|---|---|
| 733808 | 5/1966 | Canada | 166/272 |
| 1028943 | 4/1978 | Canada | 166/272 |

*Primary Examiner*—Stephen J. Novosad
*Assistant Examiner*—George A. Suchfield
*Attorney, Agent, or Firm*—Carl G. Ries; Robert A. Kulason; Charles L. Bauer

[57] ABSTRACT

A method for the in-situ recovery of viscous oils or bitumen from subterranean oil-bearing formations by the injection of steam or a mixture of steam and an oxygen-containing gas under operating conditions that utilize pressurization and drawdown cycles wherein carbon dioxide is injected at the start of the pressurization cycle.

13 Claims, 2 Drawing Figures

METHOD OF IN-SITU RECOVERY OF VISCOUS OILS OR BITUMEN UTILIZING A THERMAL RECOVERY FLUID AND CARBON DIOXIDE

BACKGROUND OF THE INVENTION

This invention relates to an improved method for the in-situ recovery of oil from oil-bearing formations containing viscous oils or bitumen. More particularly, the invention relates to an in-situ recovery method for the recovery of bitumen from tar sands by the injection of steam or a mixture of steam and an oxygen-containing gas wherein pressurization and drawdown cycles are employed and carbon dioxide is injected at the start of the pressurization cycle.

The in-situ recovery of low API gravity or viscous oils from subterranean oil-bearing formations and bitumen from tar sands has generally been difficult. Although some improvement has been realized in the in-situ recovery of heavy oils, i.e., oils having an API gravity in the range of 10° to 25° API, little success has been realized in recovering bitumen from tar sands by in-situ methods. Bitumen can be regarded as a highly viscous oil having an API gravity in the range of about 5° to 10° API and a viscosity in the range of several million centipoise at formation temperature, and contained in an essentially unconsolidated sand, generally referred to as a tar sand.

Extensive deposits of tar sands exist in the Athabasca region of Alberta, Canada. While these deposits are estimated to contain about seven hundred billion barrels of bitumen, recovery therefrom, as indicated above, using conventional in-situ techniques has not been altogether successful. The reasons for the varying degrees of success relate principally to the fact that the bitumen is extremely viscous at the temperature of the formation, with consequent very low mobility. In addition, the tar sand formations have very low permeability, despite the fact they are unconsolidated.

Since it is known that the viscosity of a viscous oil decreases markedly with an increase in temperature, thereby improving its mobility, thermal recovery techniques have been investigated for recovery of bitumen from tar sands. These thermal recovery methods generally include steam injection, hot water injection and in-situ combustion.

Typically, such thermal techniques employ an injection well and a production well traversing the oil-bearing or tar sand formation. In a conventional throughput steam operation, steam is introduced into the formation through an injection well. Upon entering the formation, the heat transferred to the formation by the hot aqueous fluid lowers the viscosity of the formation oil, thereby improving its mobility. In addition, the continued injection of the hot aqueous fluid provides the drive to displace the oil toward the production well from which it is produced.

Thermal techniques employing steam also utilize a single well technique, known as the "huff and puff" method, such as set forth in U.S. Pat. No. 3,259,186. In this method, steam is injected via a well in quantities sufficient to heat the subterranean hydrocarbon-bearing formation in the vicinity of the well. Following a period of soak, during which time the well is shut-in, the well is placed on production. After production has declined, the huff and puff technique may again be employed on the same well to again stimulate production. The application of single well schemes employing steam injection and as applied to heavy oils or bitumen is also taught in U.S. Pat. No. 2,881,838, which utilizes gravity drainage. In a later patent, U.S. Pat. No. 3,155,160 an improvement in U.S. Pat. No. 2,881,838 is described wherein steam is injected and appropriately timed pressuring and depressuring steps are employed. In the application to a field pattern, the huff and puff technique may be phased so that numerous walls are on an injection cycle while others are on a production cycle, which cycles are then reversed.

In the conventional in-situ combustion method, an oxygen-containing gas such as air is injected into the formation via an injection well and a combustion of a portion of the in-place oil adjacent the well is initiated. Injection of the air is continued, thereby establishing a combustion front that has a temperature generally in the range of 900°–1200° F. The continued injection of the air displaces the combustion front through the formation which front in turn displaces oil ahead of it through the formation to a production well from which the oil is produced. The combustion front is sustained by the combustion of a portion of the in-place oil during the movement of the front through the formation.

More recently, an improved thermal recovery method for low API crudes or bitumen has been disclosed in U.S. Pat. No. 4,006,778 which utilizes a controlled low-temperature oxidation (LTO). A mixture of steam and an oxygen-containing gas is injected into the formation to generate, and thereafter to control, an in-situ low-temperature oxidation. The mixture is injected at a temperature corresponding to the temperature of saturated steam at the pressure of the formation. By this method of low-temperature oxidation, the temperature level is established and is controlled in the formation at a temperature generally in the range of 250° to 500° F., which temperature is much lower than that of the conventional in-situ combustion process.

In other recent advancements, such as in the coassigned pending application Ser. No. 837,482, filed Sept. 28, 1977, now U.S. Pat. No. 4,127,172, the use of pressurization and drawdown cycles with the injection of thermal recovery fluids as a mixture of steam and an oxygen-containing gas has been described. Pressurization of the formation, for example, may be accomplished by employing a higher injection rate than the production rate. Thereafter, drawdown, which is a reduction in formation pressure, may be accomplished by producing at a rate greater than the injection rate.

Other methods for enhanced recovery described in the prior art include the use of an injection fluid such as a low molecular weight hydrocarbon or carbon dioxide that is soluble or miscible with the in-place crude. In the case of carbon dioxide, when it dissolves in oil, at pressures less than the miscibility pressure, viscosity reduction, and swelling of the oil occur in the formation which have beneficial results in increasing oil recovery. The use of carbon dioxide at pressures lower than the miscibility pressure for carbon dioxide and oil is described, for example, in U.S. Pat. No. 3,252,512; and the use of carbon dioxide at pressures of from about 1000 psi to about 4000 psi is taught in U.S. Pat. No. 2,623,596. Carbon dioxide may also be employed under conditions of conditional miscibility, as set forth in U.S. Pat. No. 3,811,502, which teaches a recovery method wherein the pressure of the formation is at, or adjusted to, the pressure at which the carbon dioxide is conditionally miscible with the oil in the formation.

Prior art also teaches the use of steam in combination with carbon dioxide. In U.S. Pat. No. 3,412,794 there is taught the recovery of oil by the injection of steam into the oil-bearing stratum with production restricted to a lower level, whereby heat loss is reduced by the injection of carbon dioxide into an upper-level, high permeability zone. In U.S. Pat. No. 3,452,492 there is taught a steam drive process whereby steam is injected for an extended period of time and thereafter a slug, solely of gas other than steam, for example, carbon dioxide, is injected so as to drive said steam and condensate deeper into the formation and to displace the oil therefrom. Thereafter, a second slug of steam is injected followed by another slug of gas.

In U.S. Pat. No. 3,908,762, there is disclosed the use of steam and a noncondensible gas such as carbon dioxide that is injected either simultaneously or separately and sequentially with the steam to establish a communication path in tar sand deposits for recovering viscous petroleum therefrom. In yet another teaching, U.S. Pat. No. 3,948,323, recovery of oil is effected by injecting a heated fluid comprising steam and a noncondensible gas such as carbon dioxide. After the injection rate diminishes to a predetermined level, a heated noncondensible gas without steam is injected until a desired injection rate is reached. The injection of the mixture of steam and noncondensible gas is then again undertaken.

We have now found that additional recovery of viscous oil or bitumen can be realized in an in-situ recovery process utilizing the injection of a thermal recovery fluid if carbon dioxide is injected with the injection of the thermal recovery fluid and the injection of the carbon dioxide is phased with pressurization and drawdown cycles employed during the operation.

SUMMARY OF THE INVENTION

This invention relates to an improved in-situ method for recovering low API gravity or viscous oils and, more particularly, to the production of bitumen from tar sands by the injection of steam or a mixture of steam and an oxygen-containing gas wherein pressurization and drawdown cycles are employed and carbon dioxide is injected at the commencement of the pressurization cycle.

DESCRIPTION OF THE PREFERRED EMBODIMENT

Figure 1:
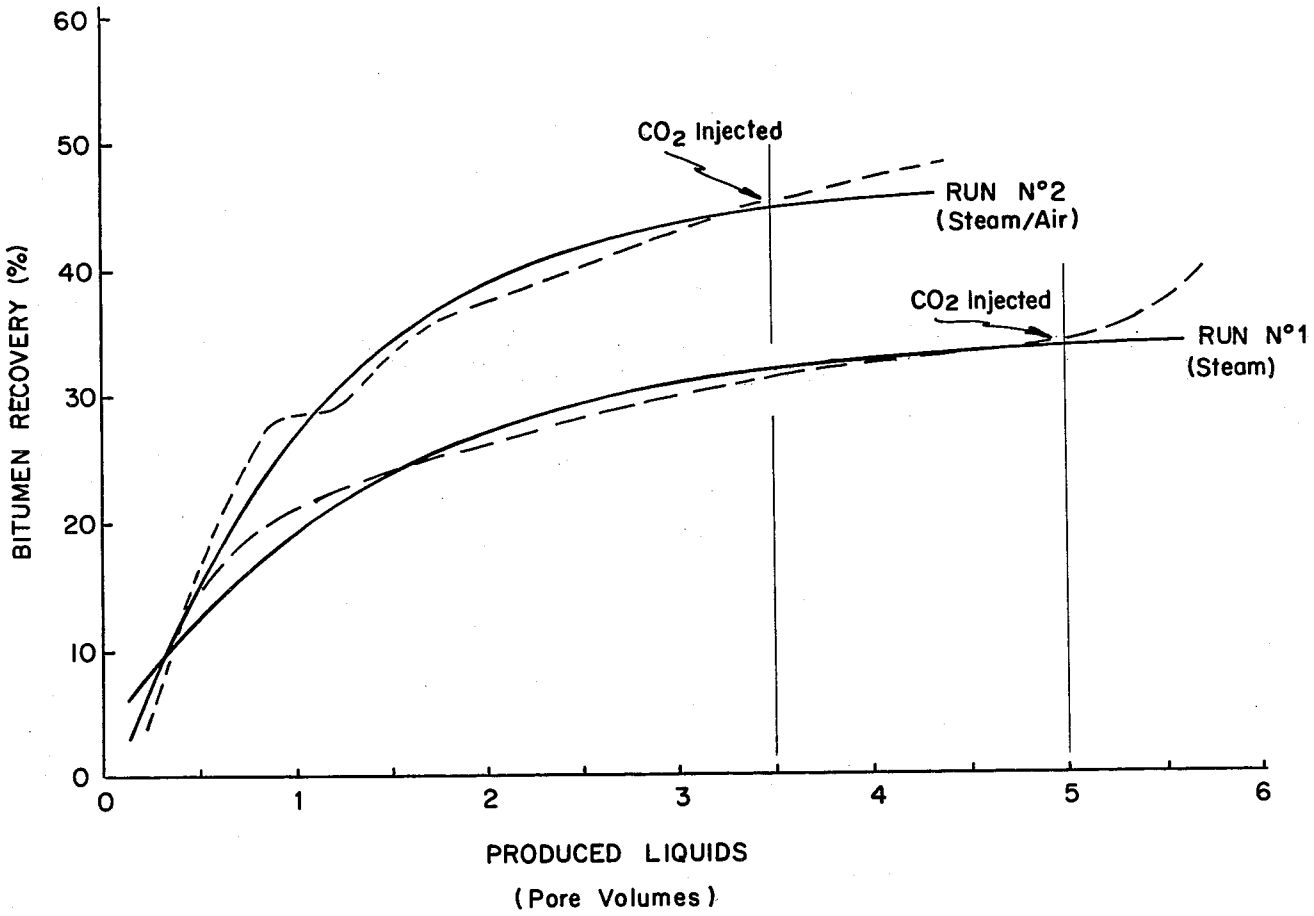
FIG. 1 compares bitumen recovery (percent) versus the pore volumes of produced liquids for tests employing the injection of steam and the injection of a mixture of steam and air and in which carbon dioxide was injected at the end of the runs.

In its broadest aspect this invention relates to an improved method of in-situ thermal recovery of low API gravity or viscous oils from an oil-bearing formation or bitumen from tar sands by the injection of a thermal recovery fluid. More particularly, the invention is based on the finding that significant increase in bitumen recovery is realized if, phased with the injection of steam or a mixture of steam and an oxygen-containing gas wherein pressurization and drawdown cycles are utilized, a fluid comprising carbon dioxide is injected at the start of the pressurization cycle. By pressurization and drawdown cycles we mean that pressure-change cycles are employed during the operation wherein injection rates relative to production rates are higher, thereby resulting in raising the level of the formation pressure to accomplish pressurization; and, correspondingly, injection rates relative to production rates are lower to decrease the level of the formation pressure, thereby accomplishing drawdown. We have found that carbon dioxide when employed with pressurization and drawdown cycles has the ability to induce a mechanical agitation by a foaming action of bitumen and water, which action facilitates the transport of bitumen through the formation toward a production well from which it is produced.

The instant invention for increasing oil or bitumen recovery may be applied to a formation which is being or has been produced by the injection of a thermal recovery fluid such as steam or a mixture of steam and an oxygen-containing gas. In this method, the thermal recovery fluid, generally is injected at temperatures preferably in the range of 250° to 500° F. or the temperature corresponding to the saturation temperature of the steam at the pressure of the formation. The quality of the steam, which is defined as the weight percent of dry steam contained in one pound of wet steam, is preferably in the range of 60% to about 100%. If a mixture of steam and an oxygen-containing gas is used, the oxygen-containing gas may be air or enriched oxygen or substantially pure oxygen. By the term "oxygen-containing gas" is meant that the gas mixture contains free oxygen as one component. By "enriched" oxygen is meant that the oxygen-containing gas contains a higher percentage of free oxygen than the oxygen content in air. The ratio of the free oxygen in the oxygen-containing gas to the steam injected is preferred to be in the range of about 30 SCF of oxygen per barrel of steam to 130 SCF of oxygen per barrel of steam. Where air is used, the ratio of the air to the steam is generally in the range of about 150 SCF of air per barrel of steam to about 650 SCF of air per barrel of steam with the preferred range being 170 SCF to 250 SCF of air per barrel of steam.

Although the steam employed in the thermal recovery fluid is generally saturated, i.e. its quality is less than 100%, superheated steam may be employed in formations whose characteristics permit the use of higher temperatures and pressures.

Prior to the injection of the thermal recovery fluid it may be necessary to condition the formation to develop adequate transmissibility or to stimulate the wells. Conditioning may be accomplished by fracturing procedures well-known in the art and/or by a short period of steam injection to stimulate the wells.

The injection of the thermal recovery fluid is generally undertaken at some selected pressure level consistent with the characteristics of the formation. For example, the pressure during injection may be maintained substantially at the pressure level of the formation at the time the injection is initiated. Alternately, the pressure may be increased to and controlled at a value approaching the fracturing pressure of the formation. Or the pressure may be adjusted so that the injection pressure of the thermal recovery fluid is substantially the pressure corresponding to the temperature of saturated steam having a desired temperature range.

For purposes of this invention the pressure of the formation at the time of initiation of the first drawdown cycle, as set forth by the invention, is termed the initial formation pressure.

According to the invention, in a thermal recovery method, after production has reached an undesirable low level, a drawdown cycle is undertaken whereby the pressure in the formation is decreased to some desired lower level by means described hereinafter, thereby initiating a drawdown cycle. Drawdown may be accomplished by reducing the injection rate of the thermal recovery fluid and/or increasing the production rate of formation fluids as, for example, by producing the production wells under essentially unrestricted conditions. The injection rate during drawdown may be up to about 20% of the initial injection rate. It is preferred that the pressure decline during the drawdown cycle be continued until the pressure has decreased to a value no more than 50% of the pressure that existed in the formation at the beginning of the drawdown cycle, that is, the initial formation pressure. Generally drawdown is continued until the oil or bitumen production has declined to an undesirably low level.

With the formation at some desired low pressure level at the end of the drawdown cycle, injection of the thermal recovery fluid is terminated and injection of a fluid comprising carbon dioxide is initiated. Simultaneously, production of the formation fluids is restricted by decreasing the rate of production relative to the rate of injection so as to initiate a pressurization cycle. Pressurization may be accomplished by choking back the production well to restrict production rates relative to the injection rates. While it is desirable that the injection fluid at the start of the pressurization cycle comprise principally carbon dioxide, other gaseous components such as nitrogen, carbon monoxide, or natural gas, may be present in the injected fluid. The fluid comprising carbon dioxide may be injected until the pressure of the formation has increased an amount of about 20% to about 50% of the difference between the pressure prior to the initiation of the drawdown cycle, i.e., the initial formation pressure, and the pressure at the end of the drawdown cycle.

Thereafter, injection of the thermal recovery fluid is again undertaken while continuing the pressurization cycle until the formation pressure has attained some desired level and/or the production rate has declined to an undesirable low level. For example, the pressure level attained may be substantially the same as that at the initiation of the drawdown cycle or some value less than the fracturing pressure of the formation. During this portion of the pressurization cycle, injection of the carbon dioxide may be continued simultaneously with the injection of the thermal recovery fluid. When the desired pressure level has been attained, a second drawdown cycle is undertaken wherein the formation pressure is again reduced to some desired low level in the manner heretofore described. The pressurization and drawdown cycles may then be repeated.

The following laboratory runs demonstrate the effectiveness of the invention. The runs were conducted using a tar sand from the McMurray Formation in Alberta, Canada. For each run approximately 90 to 95 kilograms of tar sand were packed in a cell approximately 18 inches long and 24 inches in diameter. The cell was equipped for operating at controlled temperatures up to 420° F. and pressures up to 500 psig and contained simulated injection and simulated production wells. The cell pack contained many thermocouples so that temperatures throughout the pack could be measured and heat transfer rates could be calculated.

Run No. 1 involved the injection of steam and employed pressurization and drawdown cycles. In operation, steam was injected for approximately 30 minutes after which a 30 minute drawdown cycle was undertaken to reduce the pressure from an injection pressure of 300 psig to approximately zero. A second pressurization cycle involving steam injection was undertaken for 10 minutes. The drawdown and pressurization cycles were repeated until approximately 5 pore volumes of liquid had been produced. Thereafter, carbon dioxide was injected sequentially with the steam until an additional half a pore volume of liquid was produced. The injection procedure was varied so that carbon dioxide was injected at the start of the pressurization cycle to 300 psig after which drawdown occurred to 100 psig. Thereafter steam was injected to 300 psig after which drawdown occurred to 0 psig. In another variation of the cycles, carbon dioxide was injected until the pressure reached 50 psig; then steam was injected until the pressure had increased to 100 psig, after which carbon dioxide and steam were injected sequentially with the pressure during each sequential step being increased in increments of 50 psig, to a final pressure of 300 psig.

Run No. 2 was conducted using similar operating conditions, namely, the injection pressure was 300 psig and pressurization and drawdown cycles were employed. Steam was injected for approximately 30 minutes after which a drawdown cycle was undertaken for 30 minutes. A mixture of steam and air was then injected for 10 minutes. The drawdown and pressurization cycles were repeated until about 3.5 pore volumes of liquid had been produced. Carbon dioxide was then injected and pressurization and drawdown cycles were employed using the sequential injection of carbon dioxide and steam until an additional half a pore volume of liquid was produced.

The results of both runs are shown in FIG. 1, in which bitumen recovery (percent) is plotted against pore volumes of produced liquid. The solid lines represent the injection of the thermal recovery fluid without the employment of carbon dioxide, and the dotted lines show the results of carbon dioxide injection. The results show that the injection of the mixture of steam and air gave higher percent recovery of bitumen than a comparable run using steam only. At 3.5 pore volumes, for example, the run utilizing steam and air had recovered approximately 42% bitumen in contrast to the run using steam which had recovered approximately 28% bitumen. In both cases the results clearly show that a significant response was realized in percent bitumen recovered upon the injection of carbon dioxide.

Figure 2:
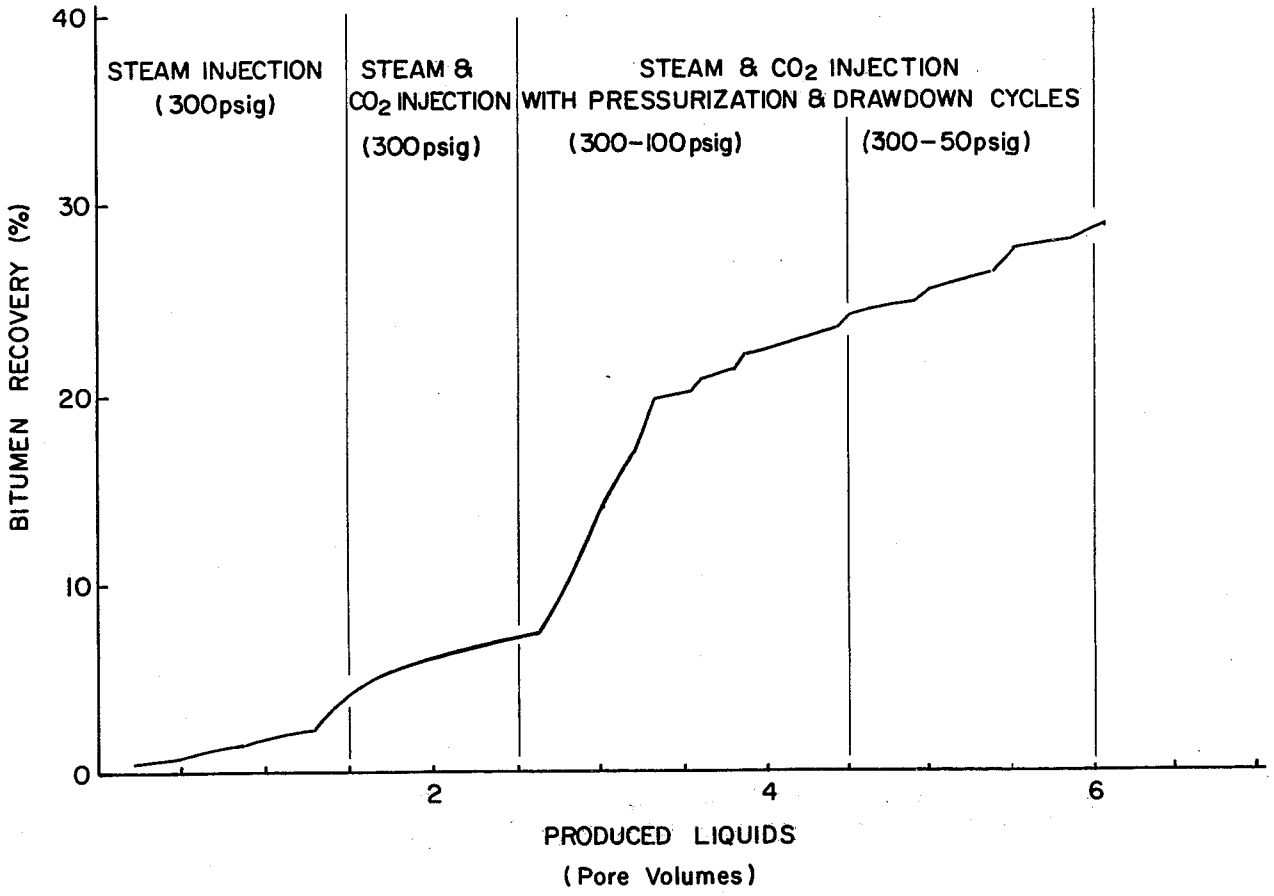
FIG. 2 illustrates bitumen recovery (percent) versus pore volumes of produced liquids in which carbon dioxide was injected with steam and at the start of the pressurization cycles.

In a third run the effectiveness of carbon dioxide was again demonstrated. Using the 24 inch diameter cell and a tar sand pack of about 90 kilograms a simulated 5-spot pattern was employed, that is, there was a simulated central injection well and four simulated offset wells. Steam was injected at 300 psig until 1.5 pore volumes of liquid had been produced. Thereafter, a mixture of steam and carbon dioxide was injected wherein the ratio of the carbon dioxide to steam was approximately 0.75 MSCF/bbl of steam until about one additional pore volume of fluid had been produced. Pressurization and drawdown cycles were thereafter employed in which a pressure differential of approximately 5 psig between the injection and the production pressures was maintained on the cell. The pressurization cycle was continued until about 300 psig had been reached, and the drawdown cycle was then undertaken until the pressure had declined to about 100 psig. Carbon dioxide was injected with the steam at the initiation of the pressurization cycle for approximately one-third to two-thirds of the pressurization cycle, that is, until 150 to 250 psig pressure had been reached and thereafter only steam was injected until the pressure had reached 300 psig. These cycles were continued until about 2 additional pore volumes of fluid were produced, after which carbon dioxide and steam were sequentially injected as previously and pressurization and drawdown cycles were employed with a minimum drawdown pressure of 50 psig until an additional 1.5 pore volumes of fluid had been produced. During the last period, carbon dioxide was injected during the first part of the pressurization cycle until the pressure reached about 50 psig, after which only steam was injected until the pressure reached 150 psig. The results are shown in FIG. 2. It can be seen that after approximately 2.5 pore volumes of liquids had been produced, a marked rise in production of bitumen occurred upon the undertaking of the pressurization and drawdown cycles together with the injection of carbon dioxide. Thereafter, the increased response of bitumen production to the injection of the carbon dioxide and steam and the pressurization and drawdown cycles can be seen.

It is postulated that in the in-situ recovery of bitumen from tar sands employing a thermal recovery fluid two principal mechanisms are involved. The first mechanism is a separation or a dislodgement of the bitumen from the sand matrix. The second mechanism relates to the transport of the dislodged bitumen through the formation to a production well. By the first mechanism of dislodgement, the bitumen is mobilized and an interface or transition zone is created between the mobilized bitumen and the bitumen in an undisturbed state. The transition zone also contains steam, condensate and connate water. With continued injection of the thermal fluid, movement of the transition zone becomes more difficult and the thermal recovery fluids, which have been effective in dislodging the bitumen principally because of the thermal benefits, become less effective as a transporting mechanism for displacing the bitumen or formation fluids through the formation. Consequently, the rate of production of oil or bitumen declines with continued injection.

By the method of invention, it is further postulated, that by stimulating the interface or transition zone by mechanical agitation of the fluids therein, movement is facilitated and displacement through the formation of the bitumen or formation fluids is enhanced. The demonstrated effectiveness of the use of pressurization and drawdown cycles is believed to be the result of mechanical agitation of the interface. By the instant invention a substantially increased effectiveness of the mechanical agitation is caused to occur by the injection of carbon dioxide, which, it is believed, is the result of the marked capability of carbon dioxide to induce a foaming action of bitumen and water in the transition zone and hence markedly increase the mechanical agitation of the fluids therein.

It is within the scope of this invention to employ the method to a subterranean oil-bearing formation that has previously undergone an in-situ recovery process, as steam flooding, in-situ combustion, or other enhanced recovery processes. The invention may be employed as a throughput operation utilizing a central injection well and offset production wells, as, for example, a 5-spot pattern. The method is also applicable to a line drive that utilizes, for example, a row of injection wells between two rows of production wells. It is also within the scope of this invention to apply the process in a huff and puff operation wherein a single well traverses the formation and steam or a mixture of steam and an oxygen-containing gas is injected via the single well to pressurize the formation after which a drawdown cycle is employed wherein the well is produced. In the huff and puff operation, the carbon dioxide is injected at the commencement of the injection phase and is continued until the pressure of the formation has attained some desired value, after which the injection phase is continued utilizing steam alone until the final pressure is reached. The operation may also employ "soak" periods such as are utilized in standard huff and puff operations.

Thus, it has been demonstrated that carbon dioxide is effective in increasing recovery of viscous oils or bitumen in an in-situ recovery process wherein a heated thermal fluid as steam or a mixture of steam and air and an oxygen-containing gas is injected and pressurization and drawdown cycles are employed and carbon dioxide is injected at the initiation of the pressurization cycle.

In summary, in accordance with the invention, for the recovery of heavy oil or bitumen in an in-situ thermal recovery process, utilizing the injection of a thermal recovery fluid, recovery is further enhanced by the injection of carbon dioxide with the injection of the thermal recovery fluid after the formation has undergone a drawdown cycle. The carbon dioxide is injected at the initiation of a pressurization cycle and is injected until the formation has been pressurized to some portion of the desired total pressurization, after which the thermal recovery fluid is injected to complete the pressurization cycle. Thereafter, the drawdown and pressurization cycles may be repeated when production has declined to an undesirable low level.

We claim:

1. In a method for the recovery of viscous oil or bitumen from a subterranean oil-bearing formation traversed by at least one injection well and one production well said formation being at an initial formation pressure wherein a thermal recovery fluid is injected via said injection well and formation fluids are produced via said production well, the improvement comprising:

(a) decreasing the rate of injection of said thermal recovery fluid relative to the rate of production of said formation fluids when production of oil or bitumen has reached an undesirable low level thereby initiating a drawdown cycle of said formation, (b) maintaining said rate of injection lower than said rate of production thereby continuing said drawdown cycle until the pressure in said formation has declined to a value no more than 50% of said pressure at the initiation of said drawdown cycle, (c) terminating injection of said thermal recovery fluid and initiating injection via said injection well of a fluid comprising carbon dioxide while simultaneously decreasing said rate of production relative to said rate of injection thereby undertaking a pressurization cycle of said formation, (d) continuing injection of said fluid comprising carbon dioxide until the pressure of said formation has increased an amount of about 20% to about 50% of the difference between the pressure in said formation at the initiation of said drawdown cycle and the pressure at the end of said drawdown cycle, (e) terminating injection of said fluid comprising carbon dioxide and initiating injection of said thermal recovery fluid while continuing said pressurization cycle, (f) continuing injection of said thermal recovery fluid until the pressure of said formation has increased to a desired pressure level but below the fracturing pressure of said formation while simultaneously maintaining said rate of production relatively lower than said rate of injection, (g) repeating steps (a) through (f).

2. The method of claim 1 wherein said thermal recovery fluid is steam.

3. The method of claim 1 wherein said thermal recovery fluid is a mixture of steam and an oxygen-containing gas.

4. The method of claim 3 wherein said oxygen-containing gas is air, enriched oxygen, or substantially pure oxygen.

5. The method of claim 1 wherein prior to step (a) the formation is pressurized to a value approaching the fracturing pressure of the overburden by the injection of steam or a mixture of steam and an oxygen-containing gas.

6. The method of claim 1 wherein steam is first injected into said injection and production wells to condition said wells.

7. The method of claim 1 wherein said formation has previously undergone an in-situ recovery process.

8. A method for the recovery of viscous oil or bitumen from a subterranean oil-bearing formation said formation being traversed by at least one well comprising the steps of:

(a) injecting a thermal recovery fluid via said well until said formation is pressurized up to a pressure approaching the fracture pressure of said formation, (b) producing said formation via said well whereby the formation is depressurized until production has reached an undesirably low level, (c) injecting via said well a fluid comprising carbon dioxide until the pressure of said formation has increased an amount of about 20% to about 50% of the difference between the pressure in said formation prior to step (b) and the pressure in said formation at the start of step (c), (d) terminating injection of said fluid comprising carbon dioxide and injecting via said well said thermal recovery fluid until the pressure of the formation has increased to approximately the value of the pressure in step (a), (e) repeating steps (b) through (d).

9. The method of claim 8 wherein said well is shut-in and the formation undergoes a soak period after step (a) and/or step (d).

10. The method of claim 8 wherein said thermal recovery fluid is steam.

11. The method of claim 8 wherein said thermal recovery fluid is a mixture of steam and an oxygen-containing gas.

12. The method of claim 11 wherein said oxygen-containing gas is air, enriched oxygen, or substantially pure oxygen.

13. The method of claim 8 wherein steam is injected simultaneously with said carbon dioxide during step (c).

* * * * *